US010010182B1

(12) United States Patent
Chen

(10) Patent No.: US 10,010,182 B1
(45) Date of Patent: Jul. 3, 2018

(54) DEVICE FOR VERTICALLY ADJUSTING CHAIR HEADREST

(71) Applicant: ATEC INTERNATIONAL TEAM CO., LTD., Taoyuan (TW)

(72) Inventor: Te-Chun Chen, Taoyuan (TW)

(73) Assignee: Atec International Team Co., Ltd., Luzhu Dist., Taoyuan (TW)

( * ) Notice: Subject to any disclaimer, the term of this patent is extended or adjusted under 35 U.S.C. 154(b) by 0 days.

(21) Appl. No.: 15/495,340

(22) Filed: Apr. 24, 2017

(51) Int. Cl.

| | |
|---|---|
| ***A47C 1/10*** | (2006.01) |
| ***A47C 7/36*** | (2006.01) |
| ***A61G 15/00*** | (2006.01) |
| ***B60R 22/28*** | (2006.01) |
| ***A47C 7/38*** | (2006.01) |

(52) U.S. Cl.
CPC ..... *A47C 7/383* (2013.01)

(58) Field of Classification Search
CPC ..... A47C 7/383; A47C 7/402; A47C 7/38; A47C 1/03; A47C 1/036; B60N 2/80; B60N 2/806; B60N 2/882; B60N 2/809; B60N 2/812; B60N 2/829; B60N 2/815; B60N 2/821
USPC ..... 297/410, 411.36, 411.37, 353, 397
See application file for complete search history.

(56) References Cited

U.S. PATENT DOCUMENTS

| | | | | |
|---|---|---|---|---|
| 3,802,737 | A * | 4/1974 | Mertens | B60N 2/045 297/216.2 |
| 6,276,757 | B1 * | 8/2001 | Brown | A47C 7/402 297/353 |
| 8,939,500 | B2 * | 1/2015 | Voigt | A47B 83/02 297/170 |
| 9,179,776 | B2 * | 11/2015 | Huang | A47C 1/03 |
| 9,380,878 | B1 * | 7/2016 | Chen | A47C 7/38 |
| 2001/0013718 | A1 * | 8/2001 | Beck | B60N 2/20 297/410 |
| 2003/0178882 | A1 * | 9/2003 | Schmitz | A47C 1/03255 297/411.36 |
| 2008/0036265 | A1 * | 2/2008 | Pan | A47C 1/03 297/411.36 |
| 2008/0309140 | A1 * | 12/2008 | Ho | A47C 1/03 297/411.36 |
| 2010/0244531 | A1 * | 9/2010 | Pai | A47C 1/03 297/411.36 |

(Continued)

FOREIGN PATENT DOCUMENTS

| | | |
|---|---|---|
| CN | 205696735 U | 11/2016 |
| DE | 202016101985.0 | 5/2016 |

*Primary Examiner* — Mark R Wendell
(74) *Attorney, Agent, or Firm* — Muncy, Geissler, Olds & Lowe, P.C.

(57) ABSTRACT

An adjustment device for vertically adjusting a chair headrest is revealed and is installed on a seat back frame while in use. The adjustment device includes a sliding member, a fixing member and a button set. A vertical toothed part of the button set is moved and separated from a first rack of the sliding member when the button set is pressed. Then the sliding member is moved vertically relative to the fixing member for synchronous adjustment of vertical position of the headrest. After the button set being released, the vertical toothed part of the button set is turned back and engaged with the first rack of the sliding member. Thus the sliding member and the headrest are positioned at a new position after the adjustment.

7 Claims, 6 Drawing Sheets

(56) References Cited

U.S. PATENT DOCUMENTS

| | | | | |
|---|---|---|---|---|
| 2012/0104807 | A1* | 5/2012 | Lauchle | A47C 7/383<br>297/180.11 |
| 2014/0292052 | A1* | 10/2014 | Parker | A47C 7/38<br>297/342 |
| 2017/0079438 | A1* | 3/2017 | Speicher | A47C 7/383 |
| 2017/0113582 | A1* | 4/2017 | Michalak | B60N 2/809 |

* cited by examiner

DEVICE FOR VERTICALLY ADJUSTING CHAIR HEADREST

BACKGROUND OF THE INVENTION

The present invention relates to a device for vertically adjusting headrests, especially to a device for vertically adjusting chair headrests and having a sliding member, a fixed member and a button set.

Nowadays people focus on comfort and functions of chairs. Thus armrests, waist support or a headrest of the chair are added with certain devices to become multifunctional. For example, the armrest is able to be moved in forward-and-backward directions, or leftward-and-rightward directions. The waist support or the headrest can be adjusted vertically.

However, a larger and direct force is required to be applied to the conventional adjustment device for vertically adjusting the headrest. The force applied results in loud noise. The larger force required would cause inconvenience to the elderly, women and children.

Moreover, refer to TW105109443, CN201620252226.5, U.S. Ser. No. 15/149,893, and DE202016101985.0, these prior arts have revealed the button operation and the use of damper gears. Yet these are applied to the armrest of the chair, not to the armrest. The arrangement and action of both moving parts and fixing parts of the armrest and those of the headrest are quite different. The inventor of the present invention also has invented certain prior arts related to the headrest of the chair such as CN201610844760.4, U.S. Ser. No. 15/292,649, etc. But the technical and structural features of these prior arts are different from those of the present invention. Thus there is room for improvement and there is a need to provide a novel device for vertically adjusting the headrest of the chair.

SUMMARY OF THE INVENTION

Therefore it is a primary object of the present invention to provide a device for vertically adjusting a chair headrest, and allowing users to adjust vertical position of the headrest by easy operation. Moreover, the device has low resistance and low noise.

In order to achieve the above object, a device for vertically adjusting a chair headrest according to the present invention is installed on a seat back frame for vertical adjustment of the headrest relative to the seat back frame and is including a sliding member, a fixing member and a button set. The sliding member is a long part extended vertically and having a headrest connecting part on a top end and a recess on a front side thereof. The headrest connecting part is for connection to the headrest. A first rack with a certain length is disposed vertically on one side wall of the recess for defining vertical movement of the headrest during adjustment. The fixing member is moveably set on the seat back frame and including a front base and a rear cover matched each other correspondingly. The front base is arranged with a first sliding groove facing the sliding member while a button slot is disposed on one side wall of the first sliding groove and corresponding to the first rack of the sliding member. A second sliding groove facing the sliding member is set on the rear cover. Thus the sliding member is moveably clipped between the first sliding groove of the front base and the second sliding groove of the rear cover and sliding vertically therebetween. The button set is elastically and movably mounted in the button slot of the fixing member and also clipped between the front base of the fixing member and the sliding member. The button set consists of a pressed portion projecting from the front base of the fixing member for being pressed by users, a projecting portion integrally disposed on one side of the pressed portion and extended toward the button slot of the fixing member, a vertical toothed part integrally arranged at one side of the projecting portion and facing the first rack of the sliding member, and at least one elastic portion for providing the button set an elastic restoring force after the button set being pressed. The vertical toothed part can be engaged with or separated from the first rack correspondingly. The elastic portion is compressed and deformed when the button set is pressed and moved into the button slot of the fixing member. Thus the vertical toothed part of the button set is moved and separated from the first rack of the sliding member for allowing vertical movement of the sliding member relative to the fixing member and synchronous adjustment of vertical position of the headrest. The button set is turned back elastically by the elastic restoring force from the elastic portion after the sliding member being adjusted to a new position and the button set being released. The vertical toothed part of the button set is also turned back to be engaged with a new position of the first rack of the sliding member. At the moment, the sliding member is unable to be moved and adjusted vertically with respect to the fixing member. The headrest is positioned at the new position after the adjustment.

DETAILED DESCRIPTION OF THE PREFERRED EMBODIMENTS

Figure 1:
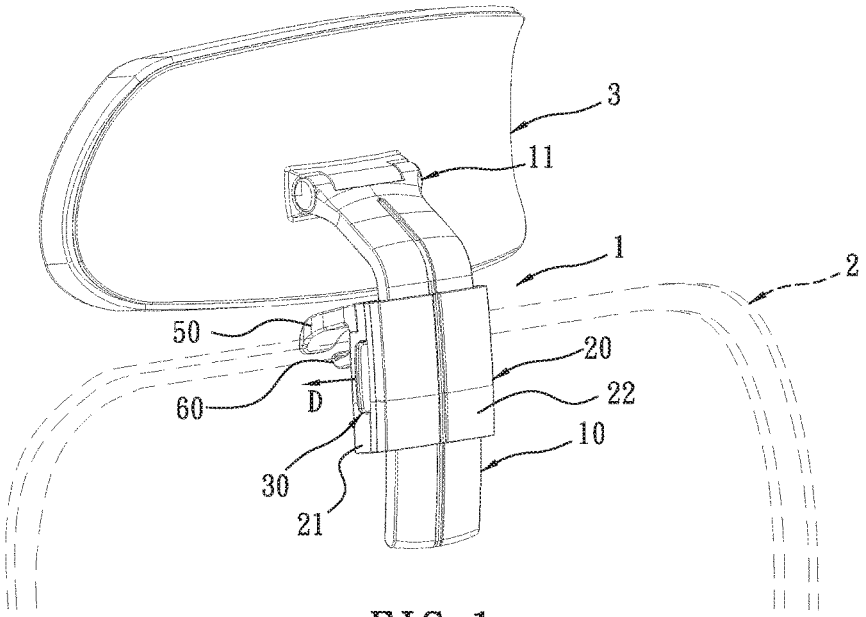
FIG. 1 is a perspective view showing a headrest of an embodiment fixed on a certain position (viewed from a rear side) according to the present invention.
Figure 2:
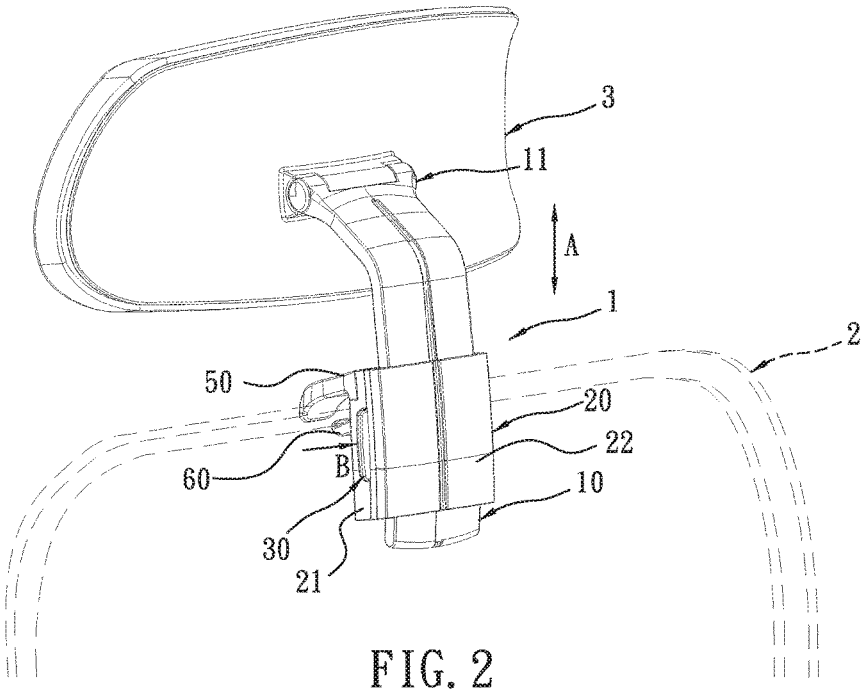
FIG. 2 is a perspective view showing a headrest of an embodiment being moved and adjusted to a higher position according to the present invention.

Refer to FIG. 1 and FIG. 2, a device 1 for vertically adjusting a chair headrest 3 according to the present invention is installed on a seat back frame 2 so that the headrest 3 is able to be moved and adjusted vertically relative to the seat back frame 2 (or a seat back). The device 1 mainly includes a sliding member 10, a fixing member 20 and a button set 30.

Figure 3:
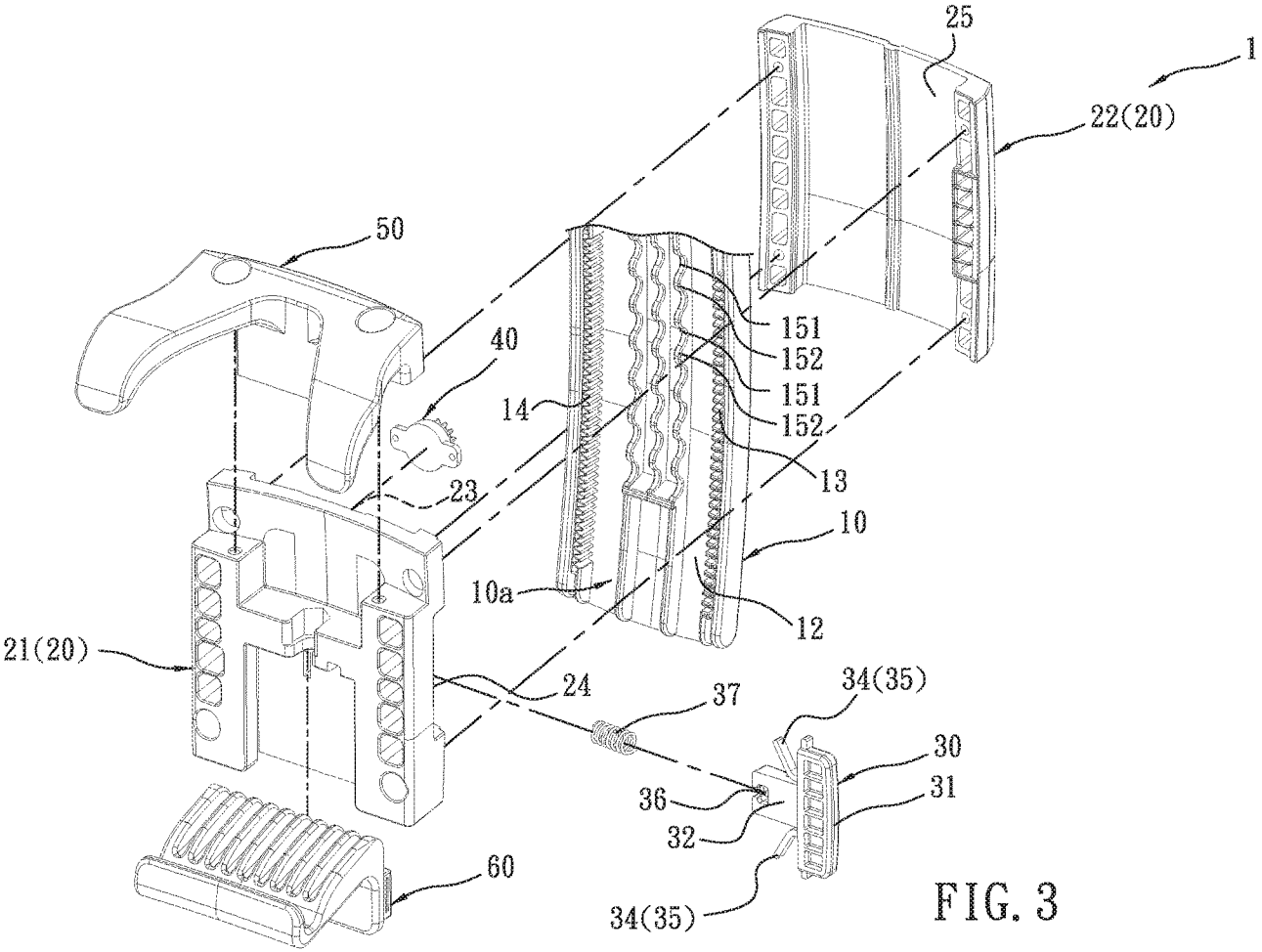
FIG. 3 is an explosive view of an embodiment (viewed from a front side) according to the present invention.
Figure 4:
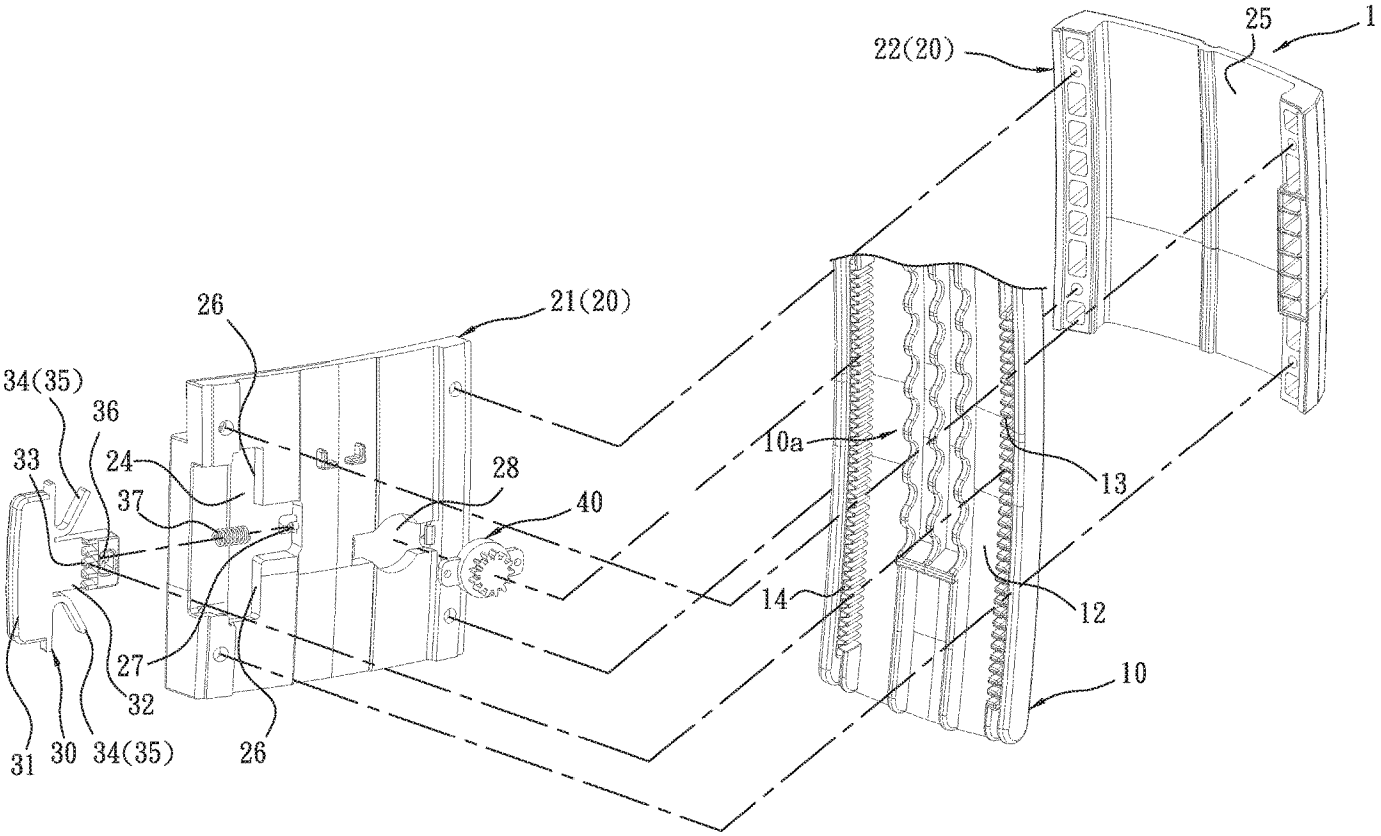
FIG. 4 is a partial explosive view of the embodiment in FIG. 3 according to the present invention.

Refer to FIG. 3 and FIG. 4, the sliding member 10 is a long part extended vertically and having a headrest connecting part 11 on a top end thereof for connection to the headrest 3. A recess 12 is arranged on a front side 10*a* of the sliding member 10 and a first rack 13 with a certain length is disposed vertically on one side wall of the recess 12 for defining vertical movement of the headrest 3 during adjustment. For example, the first rack 13 is on the right side wall of the recess 12. The sliding member 10 can be a long straight body or a long curved body.

The fixing member 20 is moveably arranged at the seat back frame 2 and including a front base 21 and a rear cover 22 matched each other correspondingly. A first sliding groove 23 is arranged at the front base 21 and facing the front base 21. A button slot 24 is disposed on one side wall of the first sliding groove 23. As shown in FIG. 3 and FIG. 4, the button slot 24 is located at the right side wall of the first sliding groove 23 and is corresponding to the first rack 13 of the sliding member 10. A second sliding groove 25 is set on the rear cover 22 and facing the sliding member 10. Thus the sliding member 10 is moveably clipped between the first sliding groove 23 of the front base 21 and the second sliding groove 25 of the rear cover 22 and sliding vertically therebetween, as the arrow A in FIG. 2, FIG. 6 and FIG. 8 indicates.

Still refer to FIG. 3 and FIG. 4, the button set 30 is elastically and movably mounted in the button slot 24 of the fixing member 20 and also clipped between the front base 21 of the fixing member 20 and the sliding member 10. The button set 30 consists of a pressed portion 31, a projecting portion 32, a vertical toothed part 33 and at least one elastic portion 34.

Figure 5:
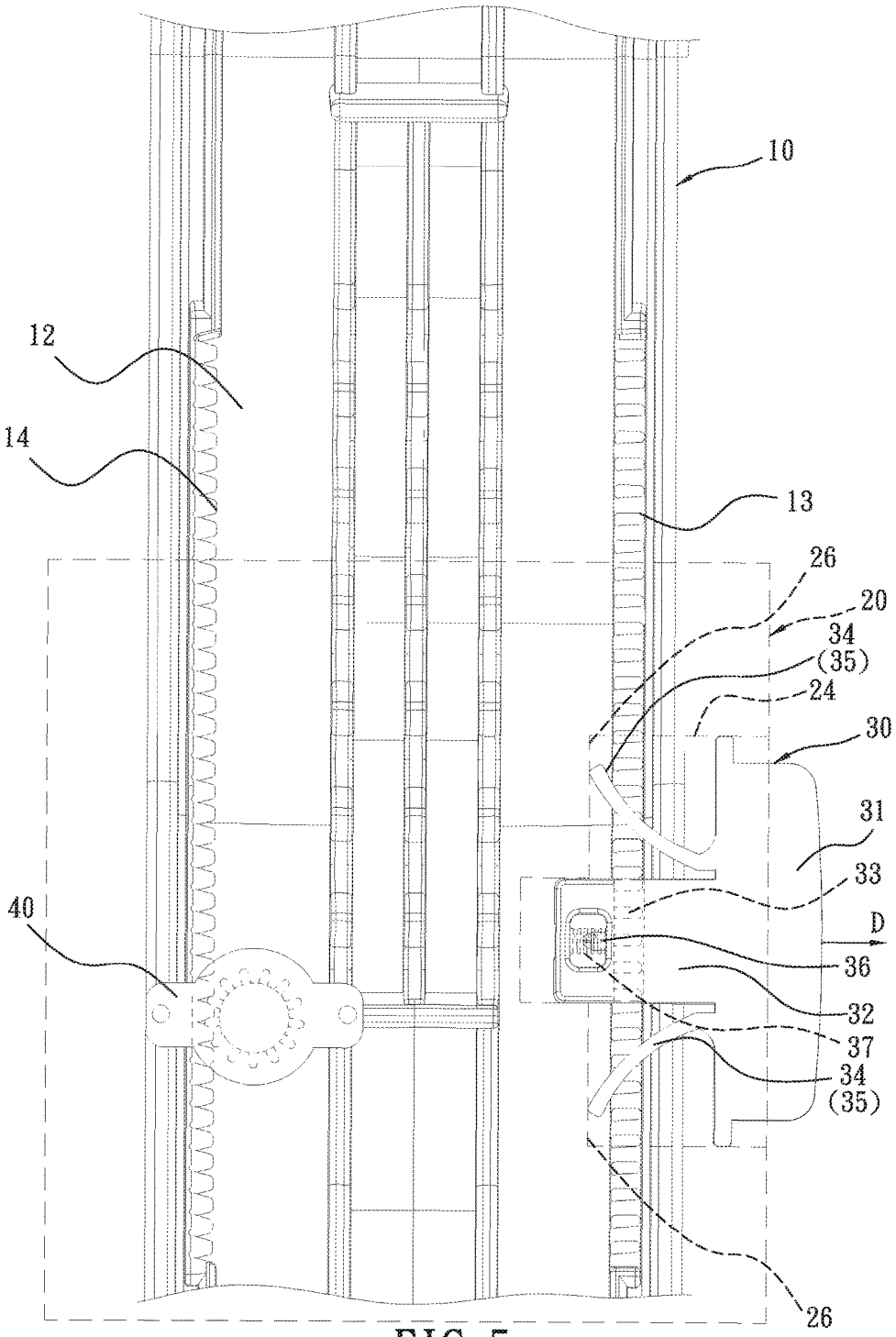
FIG. 5 is a schematic drawing showing a sliding member of an embodiment in a fixed state according to the present invention.
Figure 6:
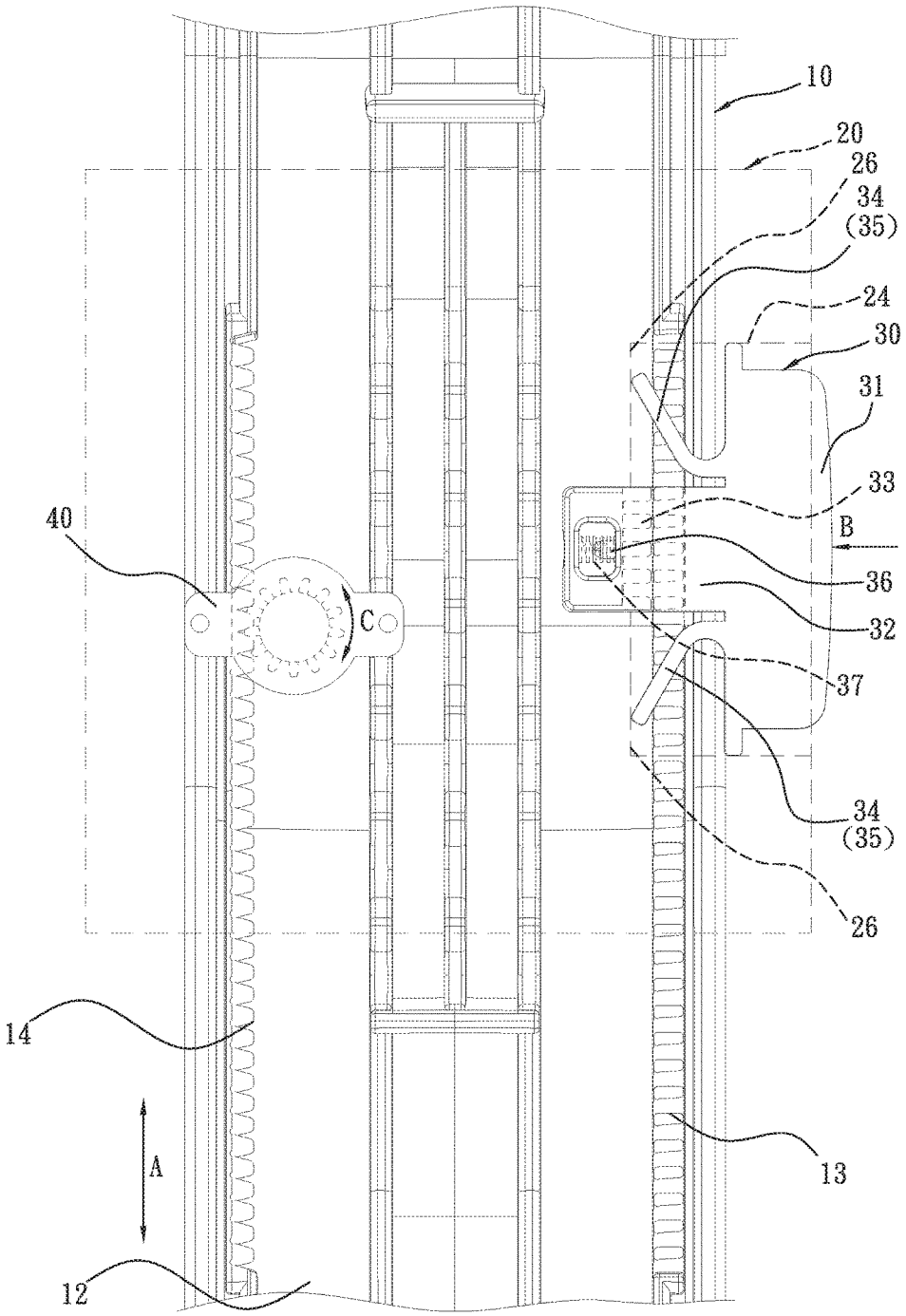
FIG. 6 is a schematic drawing showing a sliding member of the embodiment in FIG. 5 being moved and adjusted according to the present invention.
Figure 8:
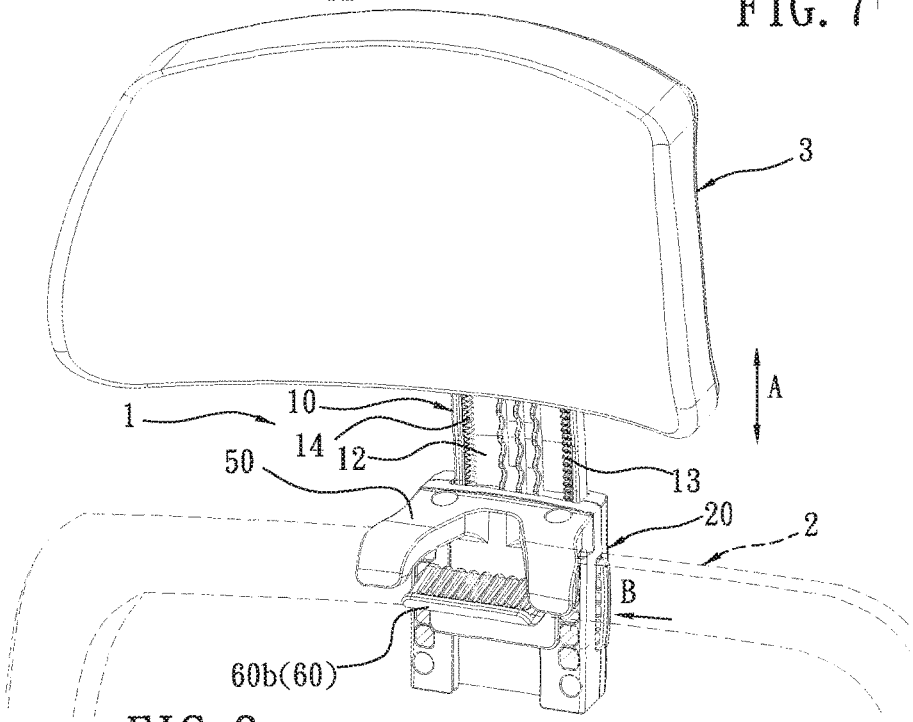
FIG. 8 is a perspective view showing another embodiment set on a seat back frame (viewed from a front side) according to the present invention.

As the arrow B shown in FIG. 2, FIG. 6, and FIG. 8 indicates, the pressed portion 31 is projecting from and exposed outside the front base 21 of the fixing member 20, for being pressed by users. The projecting portion 32 is integrally disposed on one side of the pressed portion 31 and extended toward the button slot 24 of the fixing member 20. The vertical toothed part 33 is integrally arranged at one side of the projecting portion 32 and facing the first rack 13 of the sliding member 10. Thus the vertical toothed part 33 can be engaged with the first rack 13 (as shown in FIG. 5) or separated from the first rack 13 (as shown in FIG. 6) of the sliding member 10 correspondingly. The elastic portion 34 is used to provide the button set 30 an elastic restoring force after the button set 30 being pressed.

The elastic portion 34 further includes an inclined elastic support 35. The elastic support 35 is integrally disposed on the pressed portion 31, located at the same side with the projecting portion 32, and extended slopingly toward the button slot 24 of the fixing member 20 for being stopped by a stopping portion 26 of the front base 21 in a pressed state. This helps increase the elastic restoring force after the button set 30 being released.

Figure 7:
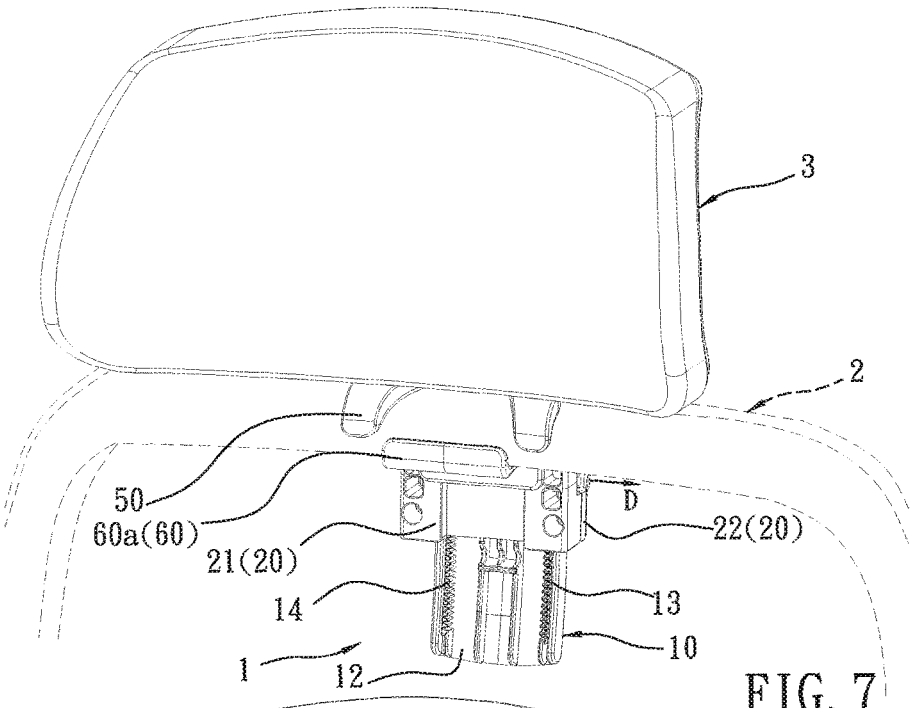
FIG. 7 is a perspective view showing an embodiment set on a seat back frame (viewed from a front side) according to the present invention.

After the sliding member 10 being adjusted to a new position and the button set 30 being released, the button set 30 is turned back elastically by the elastic restoring force from the elastic portion 34, as the arrow D in FIG. 1, FIG. 5 and FIG. 7 indicates. The vertical toothed part 33 of the button set 30 is also turned back to be engaged with a new position of the first rack 13 of the sliding member 10. At the moment, the sliding member 10 is unable to be moved and adjusted vertically with respect to the fixing member 20. The headrest 3 is positioned at the new position after the adjustment.

A head end of the projecting portion 32 of the button set 30 is further disposed with a first spring fixing end 36 while the fixing member 20 is arranged with a second spring fixing end 27 corresponding to the first spring fixing end 36. A compression spring 37 is set between the first spring fixing end 36 and the second spring fixing end 27 for providing an elastic restoring force to the button set 30 after the button set 30 being pressed. Thus the compression spring 37 can be considered as a part of the elastic portion 34.

As the arrow B in FIG. 2, FIG. 6 and FIG. 8 indicates, the elastic portion 34 is compressed and deformed so that the vertical toothed part 33 of the button set 30 is moved and separated from the first rack 13 of the sliding member 10 when the button set 30 is pressed and moved into the button slot 24 of the fixing member 20. The sliding member 10 is able to be moved vertically relative to the fixing member 20 for synchronous adjustment of vertical position of the headrest 3, as the arrow A in FIG. 2, FIG. 6 and FIG. 8 indicates.

Refer to FIG. 3 and FIG. 4, a second rack 14 is disposed on one of the side walls (the left side wall) opposite to the side wall with the first rack 13 of the sliding member 10. A gear mounting hole 28 is set on one side wall of the first sliding groove 23 of the fixing member 20, opposite to the side wall with the button slot 24. A damper gear 40 that rotates in a damped way is mounted in the gear mounting hole 28 and the second rack 14 of the sliding member 10 is meshed with the damper gear 40 correspondingly, as shown in FIG. 4, FIG. 5 and FIG. 6. Thereby the second rack 14 of the sliding member 10 is engaged with the damper gear 40 and sliding vertically (as the arrow C in FIG. 6 indicates) when the sliding member 10 is sliding vertically relative to the fixing member 20 (as the arrow A in FIG. 2, FIG. 6 and FIG. 8 indicates). Thereby the vertical movement of the sliding member 10 can be stable and smooth with low noise owing to effects of damping.

Moreover, refer to FIG. 7 and FIG. 8, an upper hook 50 and a lower hook 60 are set on and connected to the fixing member 20. During installation, the seat back frame 2 is clipped between the upper hook 50 and the lower hook 60 so that the headrest 3 is arranged over the seat back frame 2. The shape and the size of the lower hook 60 are not limited and able to be modified according to the shape and the size of the seat back frame 2. For example, the lower hook 60*a* in FIG. 7 has a longer hooked portion while the lower hook 60*b* in FIG. 8 has a shorter hooked portion. This makes the present adjustment device 1 suitable to various seat back frames 2.

Compared with prior arts, the device 1 for vertical adjustment of the headrest of the present invention has the following advantages:

(1) User can adjust the vertical position of the headrest 3 easily when the button set 30 is pressed. After the button set 30 being released, the vertical position of the headrest 3 is fixed. The design offers users greater convenience in operation of the device 1.

(2) The second rack 14 of the sliding member 10 is engaged with and sliding relative to the damper gear 40 of the fixing member 20 correspondingly while the sliding member 10 is moved vertically in the fixing member 20. Thus the vertical movement of the sliding member 10 is more stable and smooth and the sliding noise is reduced at the same time.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A device used for vertically adjusting a headrest of a chair and being disposed on a seat back frame of the chair for vertical adjustment of the headrest relative to the seat back frame comprising:

a sliding member that is a long part extended vertically and having a headrest connecting part on a top end thereof for connection to the headrest and a recess on a front side thereof and a first rack disposed vertically on one side wall of the recess;

a fixing member that is moveably set on the seat back frame and having a front base and a rear cover correspondingly matched; wherein the front base is arranged with a first sliding groove facing the sliding member and a side wall of the first sliding groove is disposed with a button slot corresponding to the first rack of the sliding member; wherein the rear cover is set with a second sliding groove facing the sliding member; wherein the sliding member is moveably clipped between the first sliding groove of the front base and the second sliding groove of the rear cover and slides vertically therebetween; and a button set elastically and movably mounted in the button slot of the fixing member and having a pressed portion projecting from the front base of the fixing member for being pressed by users, a projecting portion integrally disposed on one side of the pressed portion and extended toward the button slot of the fixing member, a vertical toothed part integrally arranged at one side of the projecting portion and able to be engaged with or separated from the first rack of the sliding member correspondingly, and at least one elastic portion for providing the button set an elastic restoring force after the button set is pressed;

wherein the vertical toothed part of the button set is capable of being moved and separated from the first rack of the sliding member so that the sliding member is moved vertically relative to the fixing member for synchronous adjustment of a vertical position of the headrest when the button set is pressed and moved into the button slot of the fixing member; wherein the button set is capable of being turned back elastically by the elastic restoring force from the elastic portion after the sliding member is adjusted to a new position and the button set is released; the vertical toothed part of the button set is also capable of being turned back to be engaged with a new position of the first rack of the sliding member; resulting in the sliding member and the headrest being positioned at the new position after being adjusted.

2. The device as claimed in claim 1, wherein the elastic portion further includes at least one inclined elastic support that is integrally disposed on the pressed portion and extended slopingly toward the button slot of the fixing member for being stopped by a stopping portion of the front base in a pressed state.

3. The device as claimed in claim 1, wherein a head end of the projecting portion of the button set is further disposed with a first spring fixing end while the fixing member is arranged with a second spring fixing end corresponding to the first spring fixing end; a compression spring is set between the first spring fixing end and the second spring fixing end for providing an elastic restoring force to the button set after the button set being pressed.

4. The device as claimed in claim 1, wherein a second rack is disposed on one side of the sliding member, opposite to the side of the sliding member with the first rack.

5. The device as claimed in claim 4, wherein a gear mounting hole is set on the first sliding groove of the fixing member and a damper gear with damping effect is mounted in the gear mounting hole; the second rack is engaged with the damper gear and sliding vertically when the sliding member is sliding vertically.

6. The device as claimed in claim 1, wherein an upper hook and a lower hook are set on and connected to the fixing member; the seat back frame is clipped between the upper hook and the lower hook so that the headrest is arranged over the seat back frame.

7. The device as claimed in claim 1, wherein the sliding member is selected from the group consisting of a long straight body and a long curved body.

* * * * *